US012345488B2

(12) United States Patent
Ocelik et al.

(10) Patent No.: US 12,345,488 B2
(45) Date of Patent: Jul. 1, 2025

(54) SELF-LOADING PISTOL WITH A PRE-COCKED FIRING PIN WITH AN ASSEMBLY FOR SAFE DISASSEMBLING

(71) Applicant: Ceska zbrojovka a.s., Uhersky Brod (CZ)

(72) Inventors: Jakub Ocelik, Slavicin (CZ); Martin Chaloupka, Uhersky Brod (CZ); Ales Kostka, Brumov-Bylnice (CZ); Lukas Kalab, Zlin (CZ)

(73) Assignee: CESKA ZBROJOVKA A.S., Uhersky Brod (CZ)

( * ) Notice: Subject to any disclaimer, the term of this patent is extended or adjusted under 35 U.S.C. 154(b) by 0 days.

(21) Appl. No.: 18/710,417

(22) PCT Filed: Dec. 6, 2022

(86) PCT No.: PCT/CZ2022/000049
§ 371 (c)(1),
(2) Date: May 15, 2024

(87) PCT Pub. No.: WO2023/109985
PCT Pub. Date: Jun. 22, 2023

(65) Prior Publication Data

US 2025/0003709 A1 Jan. 2, 2025

(30) Foreign Application Priority Data

Dec. 16, 2021 (CZ) ..... PV 2021-573

(51) Int. Cl.
*F41A 11/00* (2006.01)
*F41A 19/24* (2006.01)
*F41A 19/30* (2006.01)

(52) U.S. Cl.
CPC ..... *F41A 19/24* (2013.01); *F41A 11/00* (2013.01); *F41A 19/30* (2013.01)

(58) Field of Classification Search
None
See application file for complete search history.

(56) References Cited

U.S. PATENT DOCUMENTS 9,303,936 B2 * 4/2016 Toner ..... F41A 17/62
9,383,153 B2 7/2016 Nebeker et al.
(Continued)

FOREIGN PATENT DOCUMENTS

EP 2116804 A1 * 11/2009 ..... F41A 11/00
EP 3087338 B1 1/2018
(Continued)

OTHER PUBLICATIONS

PCT Search Report and Written Opinion dated Feb. 6, 2023 for related PCT Patent Application No. PCT/CZ2022/000049, Filed Dec. 6, 2022, 11 pages.

*Primary Examiner* — Gabriel J. Klein
(74) *Attorney, Agent, or Firm* — Hovey Williams LLP; Paul J. Walker

(57) ABSTRACT

A self-loading pistol with a pre-cocked firing pin and with an assembly for safe disassembling, comprising a trigger bar (7) with a peripherally at least partly closed frame part (7*c*) to surround a pistol magazine (39). The frame part (7*c*) having, with respect to the shooting direction, a vertical surface (7*m*) arranged on its rear side, and on the front side, a lug (7*f*) for catching a firing pin (3). The trigger bar (7) is arranged in the pistol frame on a cross pin (29) that crosses the vertical surface (7*m*). The trigger bar (7) is moveable by means of a trigger (15). In the pistol frame, over the trigger bar (7), a disassembling lever (11) is arranged that has a button (11*d*) and a pivot (11*a*) that carries a cam (18) for engagement with the trigger bar (7). The cross pin (29) passes through a guide cam (7*e*) arranged in the vertical surface (7*m*). The vertical surface (7*m*) has, at its side facing the magazine (39), a contact surface (7*i*) for the magazine
(Continued)

(39). An arm (7*k*) protrudes from the frame part (7*c*) at its front side with respect to the shooting direction. A pulling thumb (7*a*) and at a distance from it, a support stop (7*j*) being arranged at the free end of the arm (7*k*). The cam (18) has a nose (18*a*) at one side and a protrusion (18*b*) at the opposite side. The nose (18*a*) reaches between the pulling thumb (7*a*) and the supporting stop (7*j*) of the trigger bar (7). The protrusion (18*b*) is bringable into a recess (1*a*) at the facing side of the slide (1).

5 Claims, 14 Drawing Sheets

(56) References Cited

U.S. PATENT DOCUMENTS

2002/0152660 A1* 10/2002 Fluhr ..... F41A 17/36
42/70.02
2006/0249014 A1* 11/2006 Curry ..... F41A 11/00
89/196
2016/0146559 A1* 5/2016 Bantle ..... F41A 17/34
42/108
2016/0320154 A1* 11/2016 Krieger ..... F41A 17/64
2017/0184366 A1* 6/2017 Zajk ..... F41A 19/15
2019/0195587 A1* 6/2019 Thomele ..... F41A 11/00
2020/0208940 A1* 7/2020 Maeda ..... F41B 7/08
2021/0207913 A1* 7/2021 Harel ..... F41A 17/56
2023/0349655 A1* 11/2023 Balhan ..... F41A 17/34
2023/0392886 A1* 12/2023 Rainaud ..... F41A 3/66
2025/0060178 A1* 2/2025 Hell ..... F41A 17/64

FOREIGN PATENT DOCUMENTS

WO 2009048668 A1 4/2009
WO WO-2024224124 A1 * 10/2024

* cited by examiner

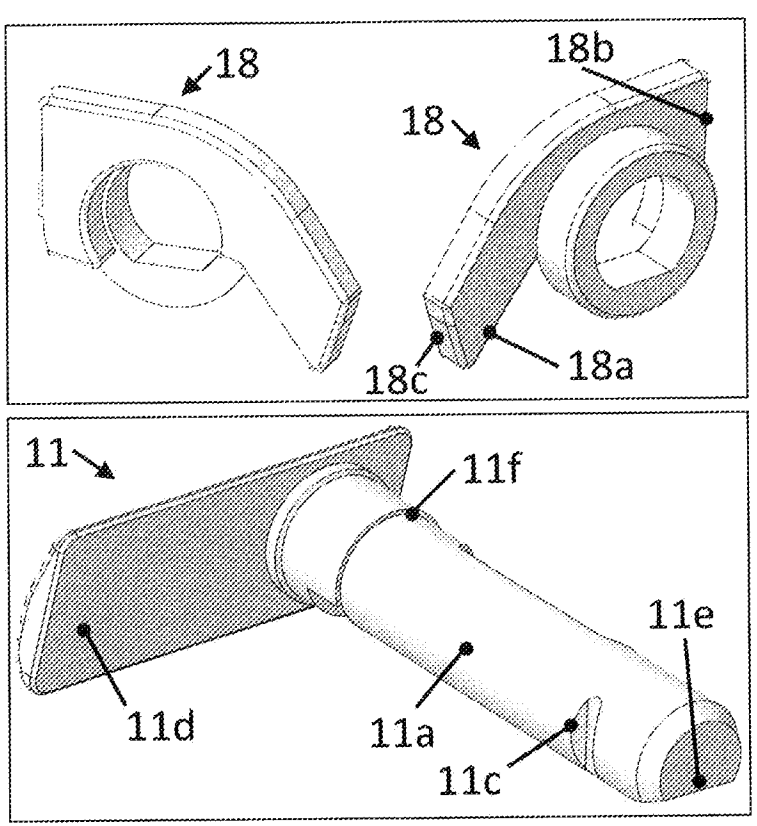
Fig. 5a
Fig. 5b
Fig. 6
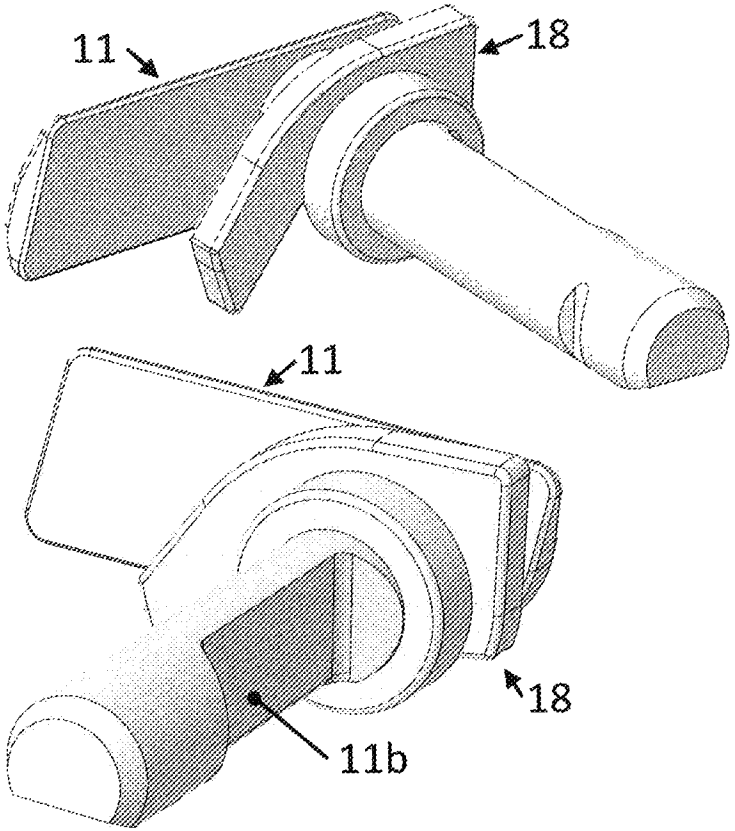
Fig. 4a
Fig. 4b

SELF-LOADING PISTOL WITH A PRE-COCKED FIRING PIN WITH AN ASSEMBLY FOR SAFE DISASSEMBLING

RELATED APPLICATIONS

This application is the National Stage of International Patent Application No. PCT/CZ2022/000049, filed Dec. 6, 2022, which is hereby incorporated herein by reference in its entirety, and which claims priority to Czech Patent Application No. PV 2021-573, filed Dec. 16, 2021, which is also incorporated herein by reference in its entirety.

TECHNICAL FIELD

The invention relates to a self-loading pistol with a pre-cocked firing pin and with an assembly for safe disassembling, comprising a trigger bar with a peripherally at least partly closed frame part to surround a pistol magazine, the frame part having, with respect to the shooting direction, a vertical surface arranged on its rear side, and on the front side, a lug (sear) for catching the firing pin wherein the trigger bar is arranged in the pistol frame on a cross pin that passes through the vertical surface, and the trigger bar is moveable by means of the trigger, and in the pistol frame, over the trigger bar, a disassembling lever is arranged with a button and a pivot carrying a cam for engagement with the trigger bar.

BACKGROUND ART

A self-loading pistol with a pre-cocked firing pin refers to a pistol that is in the "ready to fire" state. This means that the main spring is partly cocked, but in this state, it is not able to actuate the primer of the cartridge. Pulling the trigger first fully cocks the main spring (on the order of a couple of millimeters) and it is only then that the firing pin is actuated.

A key requirement that influences the design of self-loading pistols of the service type is the requirement for safety during disassembling of the pistol without manipulating the trigger. There are a number of known designs. Typical examples are presented below.

U.S. Pat. No. 10,866,043B2 (Dec. 15, 2020) describes a modification of the Glock 17/19 design to meet the requirement for disassembly without pulling the trigger. The trigger mechanism of the Glock series with a pre-cocked firing pin has remained. The design is modified in such a way that for disassembling, the magazine must be removed, the slide must be retracted and then, the striking mechanism assembly can be removed out of the slide by rotating. This disassembling concept makes use of the striking mechanism and not the trigger mechanism as is the case of all the examples below.

CA2727952A1 (Dec. 30, 2009) describes a modification of the original Croatian HS2000 design for disassembling without pulling the trigger. The trigger mechanism is of the fully cocked type. Disassembling is only made possible with the slide in the hold open position (held by the slide stop). Rotation of the disassembling lever will disengage the contact between the sear and the firing pin.

US2011126441A1 (Jun. 2, 2011) describes a design that does not make it possible to start disassembly of a pistol with the magazine present in the grip magazine well.

EP3087338B1 (Nov. 28, 2014) describes the design of the HK SFP9 pistol wherein disassembling is possible without pulling the trigger. The trigger mechanism is of the fully cocked type. Disassembling is only made possible with the slide in the hold open position (held by the slide stop). Rotation of the disassembling lever will switch the trigger mechanism to the "disassembling" mode, the contact of the firing pin and the sear is still maintained. The contact will be disengaged by an impulse of the forward movement of the slide out of the frame.

EP3017264B1 (Jun. 27, 2014) and US2016146559A1 (May 26, 2016) describe blocking of pistol disassembly with the magazine present in the grip magazine well.

US2017321982A1 (Nov. 9, 2017) describes the design of the SIG P320 pistol and deals with disassembling without pulling the trigger. The trigger mechanism is of the fully cocked type. Disassembling is only made possible with the slide in the hold open position (held by the slide stop). Rotation of the disassembling lever will disengage the contact between the sear and the firing pin.

EP2116804B1 (May 9, 2008) and US2015323274A1 (Nov. 12, 2015) describe the design of the SIG P320 pistol and deal with blocking of pistol disassembly with the magazine present in the grip magazine well.

A disadvantage of the known solutions is that the disassembling lever is blocked by means of a separate component, i.e., more than one component must be used in each case. However, at least three components are generally necessary to fulfil this function, which act in such a way that the trigger bar transmits the movement from the trigger, the sear holds the firing pin, and a magazine lever is used to block or release the disassembling lever or the sear depending on the presence of a magazine in the grip magazine well.

Another disadvantage of the known solutions is that none of them combines a pre-cocked firing pin with the disassembling design making use of the trigger mechanism. This combination is attractive because a pre-cocked firing pin offers a high safety coefficient of the entire system. And, on the other hand, using the trigger mechanism for disassembly offers high user comfort.

Another disadvantage of the known disassembling designs using the trigger mechanism is that fall safety of the sear in the standard mode ("ready to fire") is only ensured by spring loading of the concerned sear. Therefore, some designs make use of an additional measure, e.g., in the form of a palm safety.

The objective of this invention is to propose such an arrangement that will enable safe disassembly of the pistol eliminating the influence of possible user's errors.

SUMMARY OF THE INVENTION

The said objective is achieved with a self-loading pistol with a pre-cocked firing pin and with an assembly for safe disassembling, comprising a trigger bar with a peripherally at least partly closed frame part to enclose a pistol magazine, wherein the frame part has a vertical surface arranged on its rear side respective to the direction of fire, and on the front side, a lug for catching a firing pin, wherein the trigger bar is arranged in the pistol frame on a cross pin that passes through the vertical surface, and the trigger bar is moveable by means of a trigger, and in the pistol frame, over the trigger bar, a disassembling lever is arranged that has a button and a pivot that carries a cam for engagement with the trigger bar, according to the invention the principle of which is that the cross pin passes through a guide cam arranged in the vertical surface. The vertical surface has at its side facing the magazine a contact surface for the magazine. An arm protrudes from the frame part at its front side with respect to the direction of fire, and a pulling thumb and a support stop at a distance from it are arranged at the free end of the arm.

The cam has a nose at one side and a protrusion at the opposite side, wherein the nose reaches between the pulling thumb and the supporting stop of the trigger bar and the protrusion can be inserted into a recess at the facing side of the slide.

The solution according to this invention offers the following advantages:

- It will prevent disassembling of the pistol with the magazine inserted in the magazine well, independently of the trigger position;
- It will prevent disassembling of the pistol in any other position of the slide than in the slide open position (i.e., the slide is at its rear end stroke and held by the slide stop);
- It will only enable disassembling of the pistol using such a procedure that does not include manipulating the trigger (e.g., its pulling);
- It enables maintaining the firing mechanism with the firing pin pre-cocked;
- It will guarantee in the standard mode ("ready to fire") that the member that holds the firing pin in the cocked position is mechanically locked against movement in this position and, therefore, safety of the system is not dependent on spring loading.

In a preferred embodiment, the cam is mounted on the pivot of the disassembling lever in a non-rotary and dismountable way.

In another preferred embodiment, the trigger bar with the vertical surface at its end is pre-tensioned towards the slide.

At the bottom edge of the vertical surface, two hooks may be advantageously arranged symmetrically and the draw springs of the trigger bar are connected to them.

In a preferred embodiment, the guide cam in the vertical surface has a banana-like curved shape with raised ends.

BRIEF DESCRIPTION OF DRAWINGS

Examples of the design of a self-loading pistol with a pre-cocked firing pin with an assembly for safe disassembling according to the present invention are shown in the attached drawings, wherein the individual figures illustrate:

FIG. 4*a* disassembling lever with a cam

FIG. 4*b* disassembling lever with a cam in another view

FIG. 5*a* cam of the disassembling lever

FIG. 5*b* cam of the disassembling lever in another view

FIG. 6 disassembling lever without the cam mounted

EXAMPLES OF EMBODIMENTS

Figure 1:
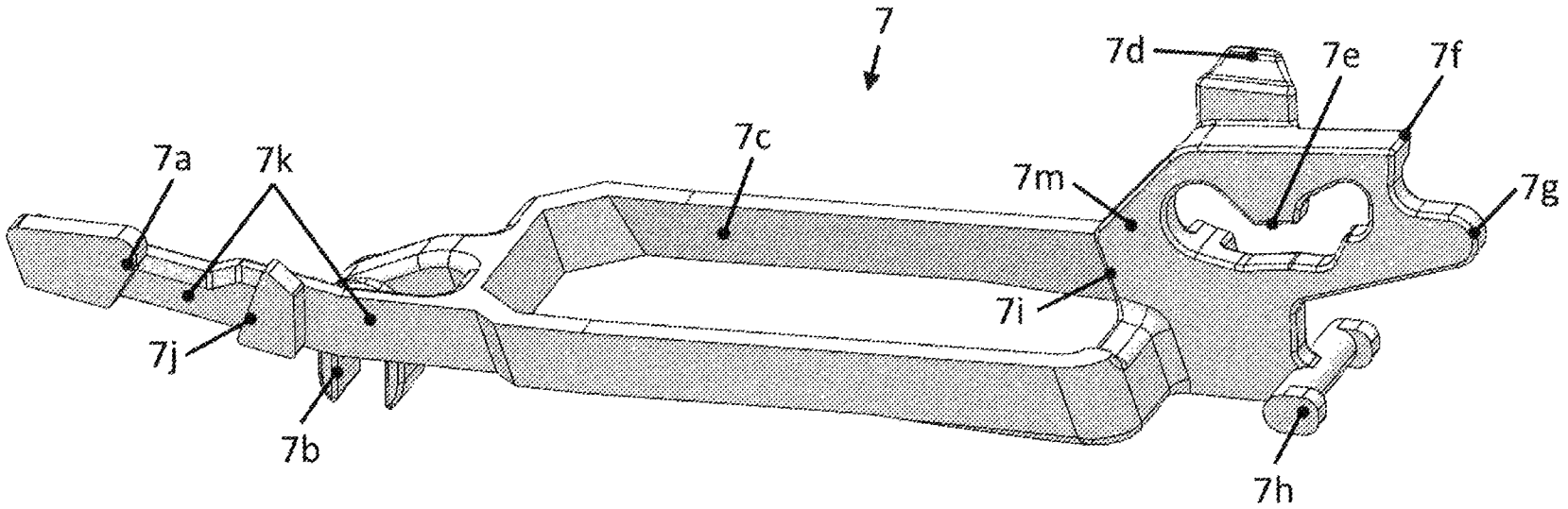
FIG. 1 detailed view of the trigger bar.
Figure 2:
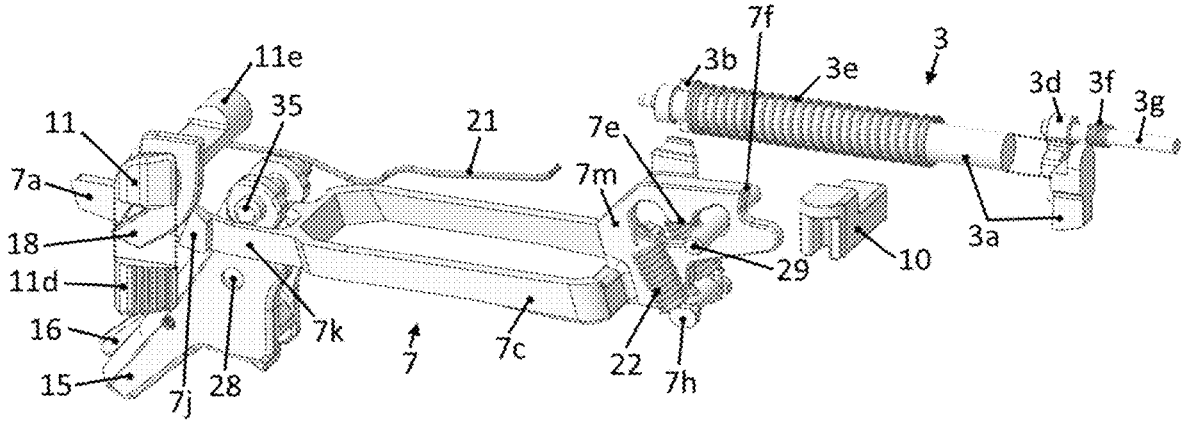
FIG. 2 first example of an embodiment of the trigger bar assembly.
Figure 3:
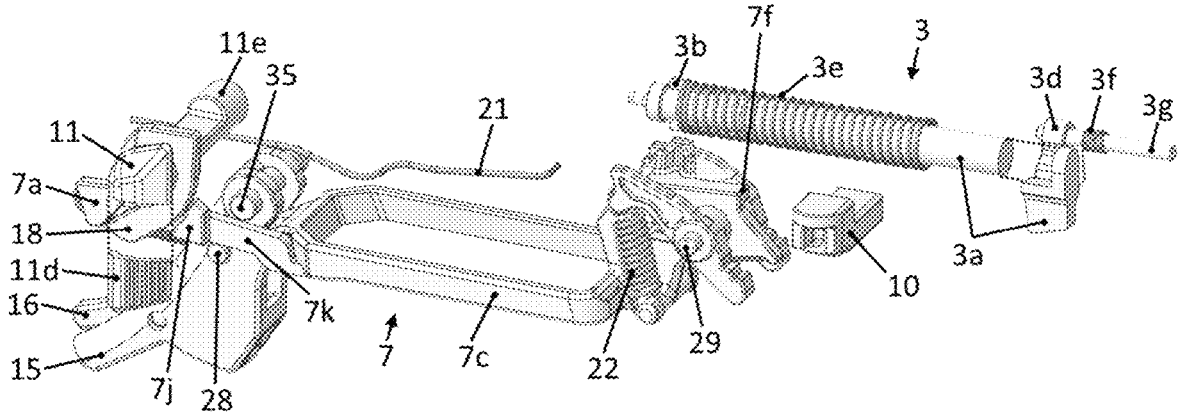
FIG. 3 second example of an embodiment of the trigger bar assembly.

The self-loading pistol with a pre-cocked firing pin with an assembly for safe disassembling has a trigger bar 7, which, in the exemplary embodiment, is shown in detail in FIG. 1. FIGS. 2 and 3 then illustrate two examples of the assembly of the trigger bar 7 that only differ in the mounting of the springs 22.

The trigger bar 7 has a peripherally at least partially closed frame part 7*c* to enclose the magazine 39 of the pistol. The frame part 7*c* has a vertical surface 7*m*, arranged at the rear side with respect to the direction of fire, with a block control 7*d* at the top side and with a lug 7*f* to catch the firing pin 3, and with a lowering thumb 7*g* at the front side. Trigger 15 revolves around trigger pin 35. When the trigger 15 is pulled, the lowering thumb 7*g* moves on the ramp on the disconnector 10 (See FIG. 2, 3) of the trigger bar to lower the entire trigger bar 7, including its lug 7*f*, subsequently causing that the firing pin 3 is released and the round in the chamber is fired.

The trigger bar 7 is mounted in the pistol frame on a cross pin 29 passes through the guide cam 7*e*, arranged in the vertical surface 7*m*. The trigger bar 7 is reset by means of the trigger 15, and in the pistol frame over the trigger bar 7, a disassembling lever 11 is arranged with a button 11*d* and a pivot 11*a* that carries a cam 18 for engagement with the trigger bar 7 (see FIGS. 4*a*, 4*b*). Through surface of pivot 11*a*, there comes groove 11*c* which locks the disassemble lever 11 via slide stop spring 21 in the directional axis of the pivot 11*a*. The separate disassembling lever 11 is shown in FIG. 6.

As shown in FIG. 1, the vertical surface 7*m* has, at the side facing the magazine 39, a contact surface 7*i* for the magazine 39. A vertical guiding groove 7*b* to receive the pin 28 of the trigger bar as well as an arm 7*k* protrude from the front side, in the direction of fire, of the part frame part 7*c*, wherein a pulling thumb 7*a* and, at a distance from it, a supporting stop 7*j* are arranged at the free end of the arm 7*k*.

Figure 16:
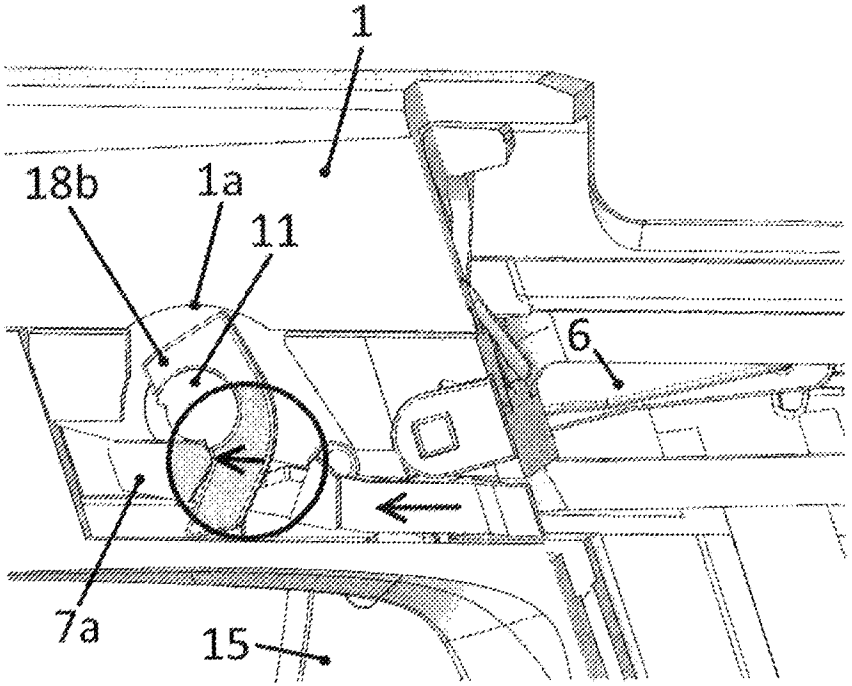

The cam 18 (see FIGS. 5*a*, 5*b*) has a nose 18*a* at one side and a protrusion 18*b* at the opposite side, wherein the nose 18*a* reaches between the pulling thumb 7*a* and the supporting stop 7*j* of the trigger bar 7 (see FIGS. 2, 3), while the protrusion 18*b* can be inserted into the recess 1*a* at the facing side of the slide 1 (see FIG. 16).

A vertical guiding groove 7*b* to receive the pin 28 (see FIGS. 2 and 3) of the trigger bar and the arm 7*k* protrude from the front side, in the direction of fire, of the frame part 7*c*. The arm 7*k* may be made integral with the frame part 7*c*, or it may be attached to the frame part 7*c*, e.g., by pressing onto a pin.

Figure 15:
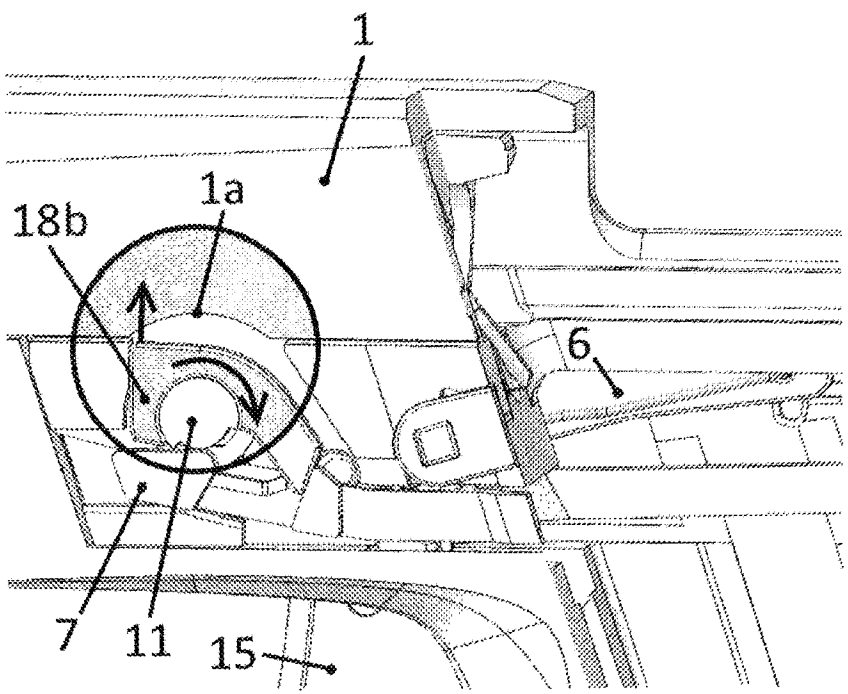
Figure 17:
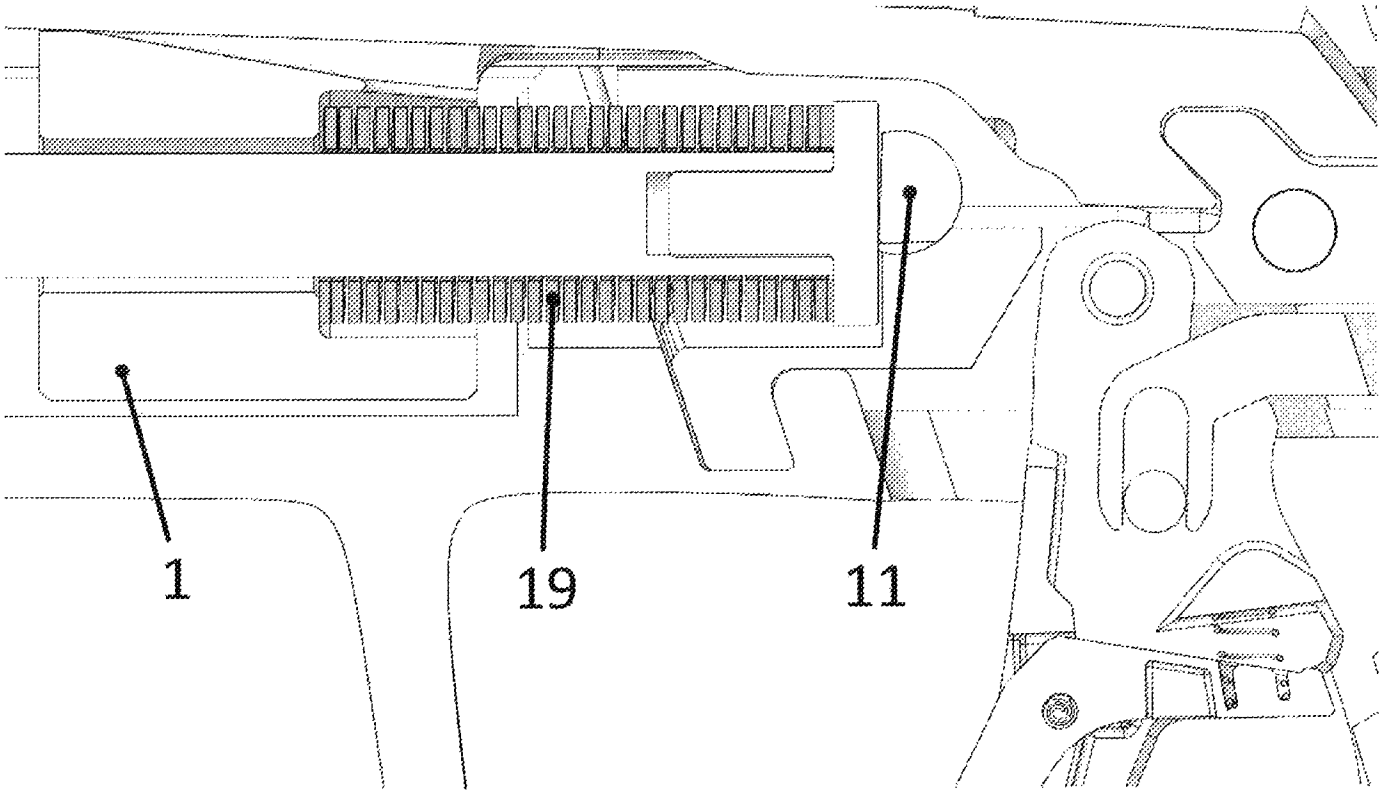

A pulling thumb 7*a* and, at a distance from it, a supporting stop 7*j* are attached to the free end of the arm 7*k*. The cam 18 has a nose 18*a* with a stop 18*c* at one side and a protrusion 18*b* at the opposite side. The nose 18*a* engages the pulling thumb 7*a* of the trigger bar, and the stop [18*e*] 18*c* delimits the position of the trigger 15 by bearing on the supporting stop 7*j* of the trigger bar 7, while the protrusion 18*b* can be inserted into the recess 1*a* at the facing side of the slide 1 (see FIGS. 15, 16).

The end of the trigger bar 7 with the vertical surface 7*m* is pre-tensioned towards the slide 1 by means of springs 22 (see FIGS. 2, 3).

In the embodiment of FIG. 2, two hooks 7*h* are symmetrically arranged at the bottom edge of the vertical surface 7*m* to which the draw springs 22 of the trigger bar 7 are connected.

The guide cam 7*e* in the vertical surface 7*m* has a banana-like curved shape with raised ends (see FIGS. 1, 2).

Figure 7:
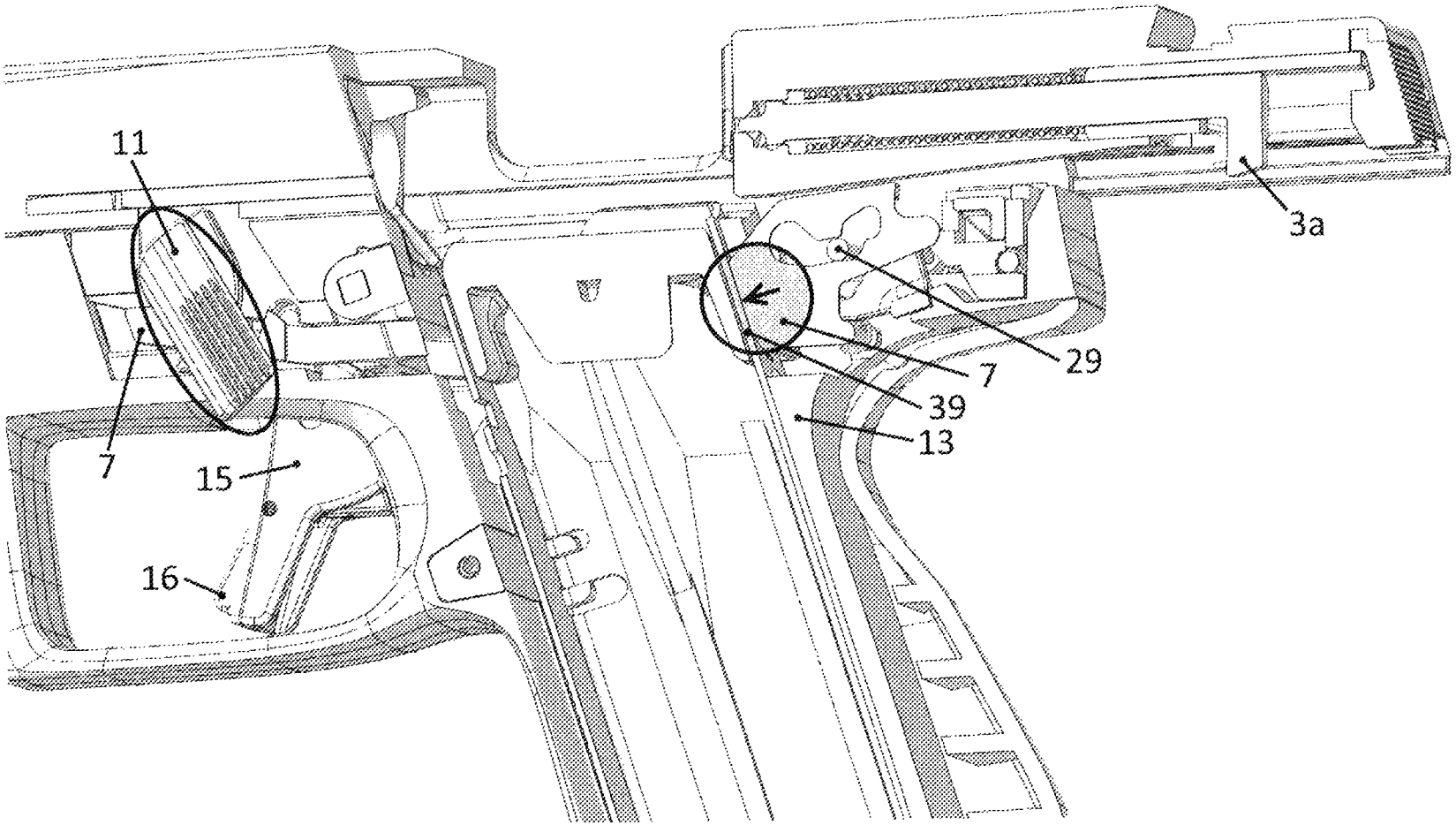
FIG. 7 pistol with an inserted magazine

If the user attempts to rotate the disassembling lever 11 into its disassembling position when the magazine 39 is inserted into the grip magazine well 13, the disassembling lever 11 pulls the trigger bar 7. The trigger bar 7, during its movement derived from the movement of the disassembling lever 11, seats on the magazine 39 and its further movement is stopped (see FIG. 7). This will also stop the movement of the disassembling lever 11 and the user is prevented from continuing the disassembling.

Figure 8:
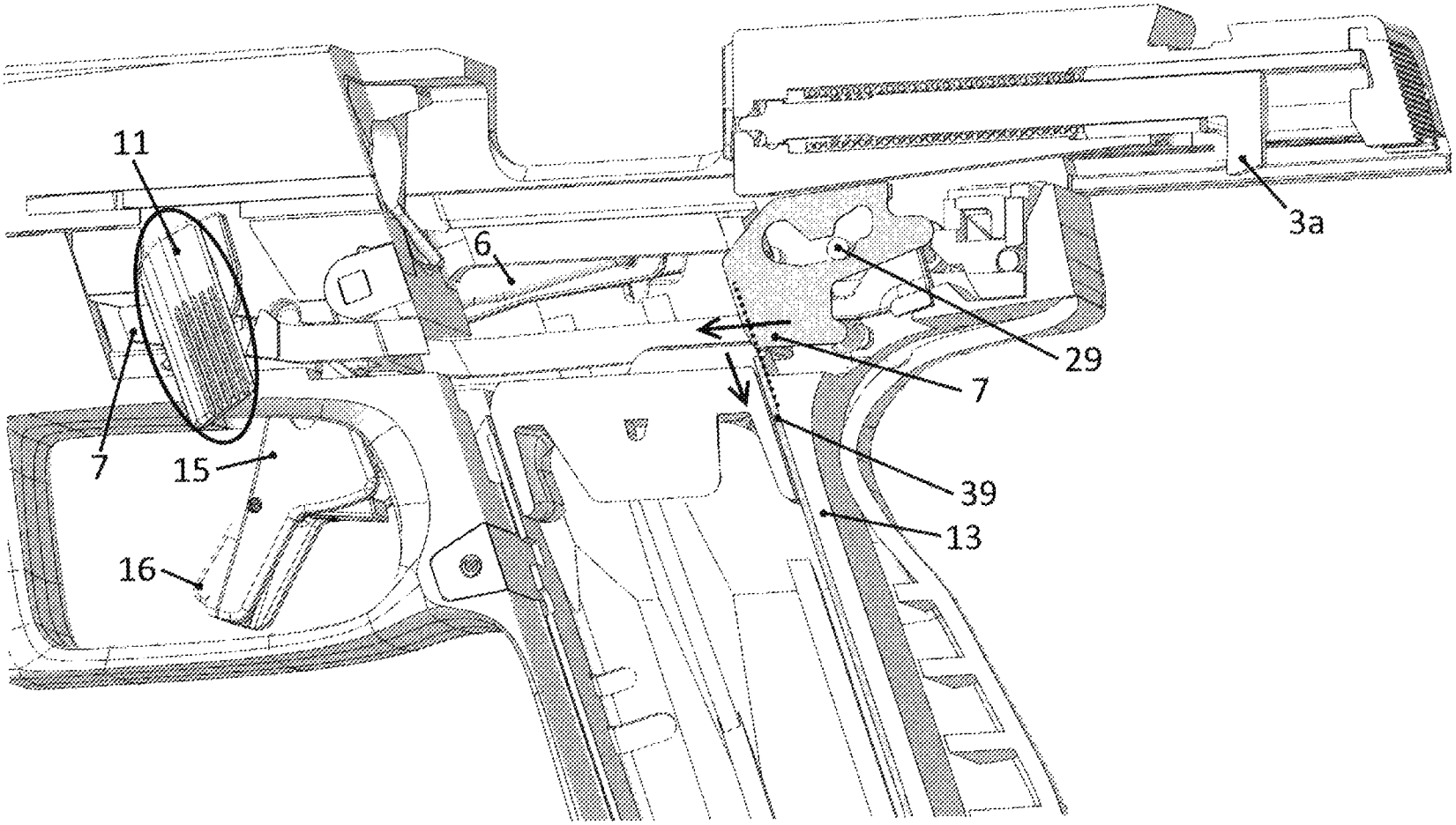
FIG. 8 pistol with the magazine removed

As soon as the magazine 39 has been removed from the grip magazine well 13, the magazine 39 makes space for the trigger bar 7, as indicated by the dotted line in FIG. 8. On condition the slide 1 is in slide-open position, i.e., it is held by the slide stop 6 of the slide 1 in the rear position, the movement of the trigger bar 7 is released, together with the dependent movement of the disassembling lever 11, and disassembling is enabled. The trigger bar 7 can move inwards into the grip magazine well 13.

Figure 9:
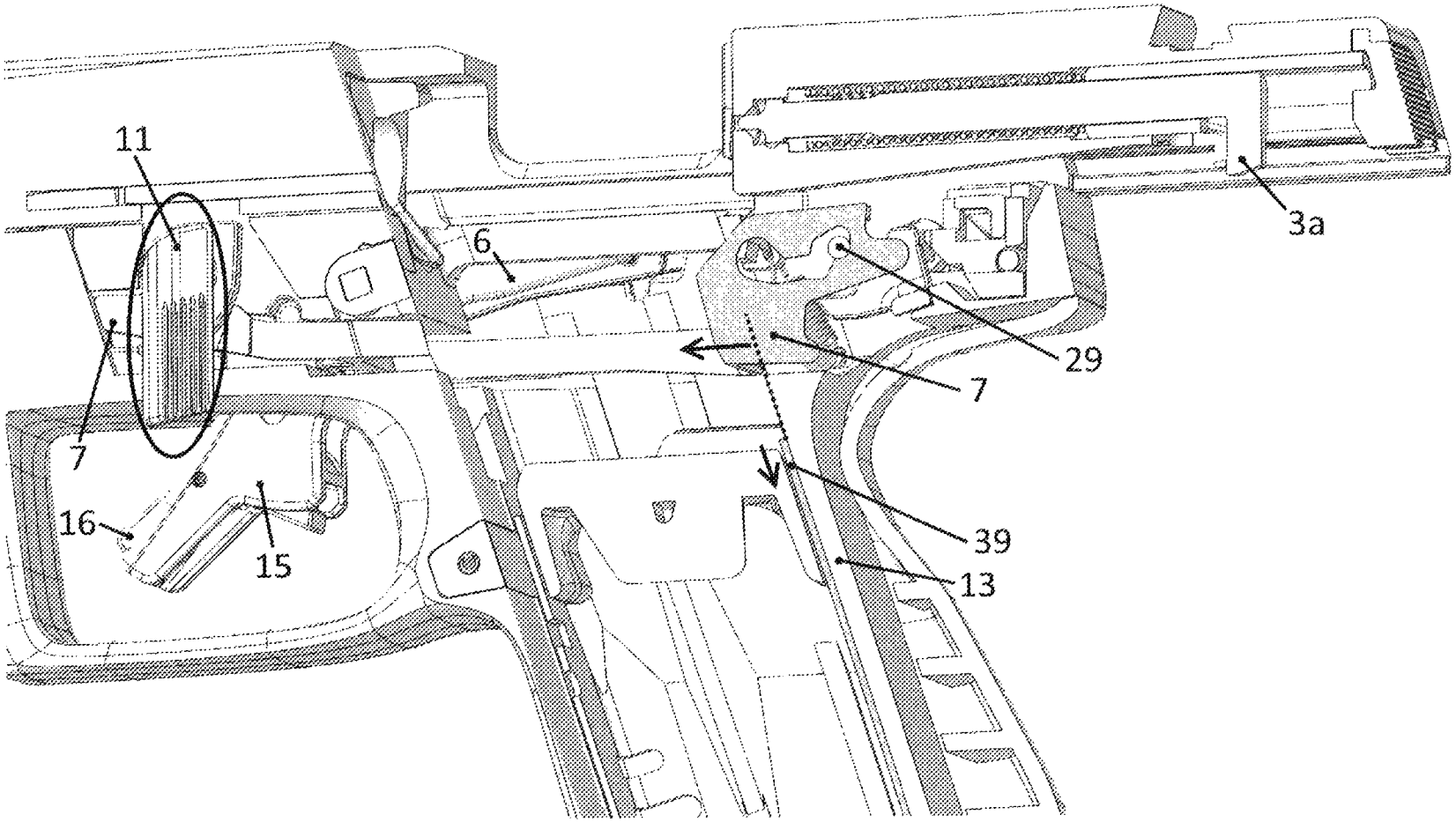
FIG. 9 pistol with the magazine removed and the trigger bar shifted

With the magazine 39 removed, the disassembling lever 11, and subsequently also the trigger bar 7 can be shifted to their final position for disassembling (see FIG. 9).

Figure 10:
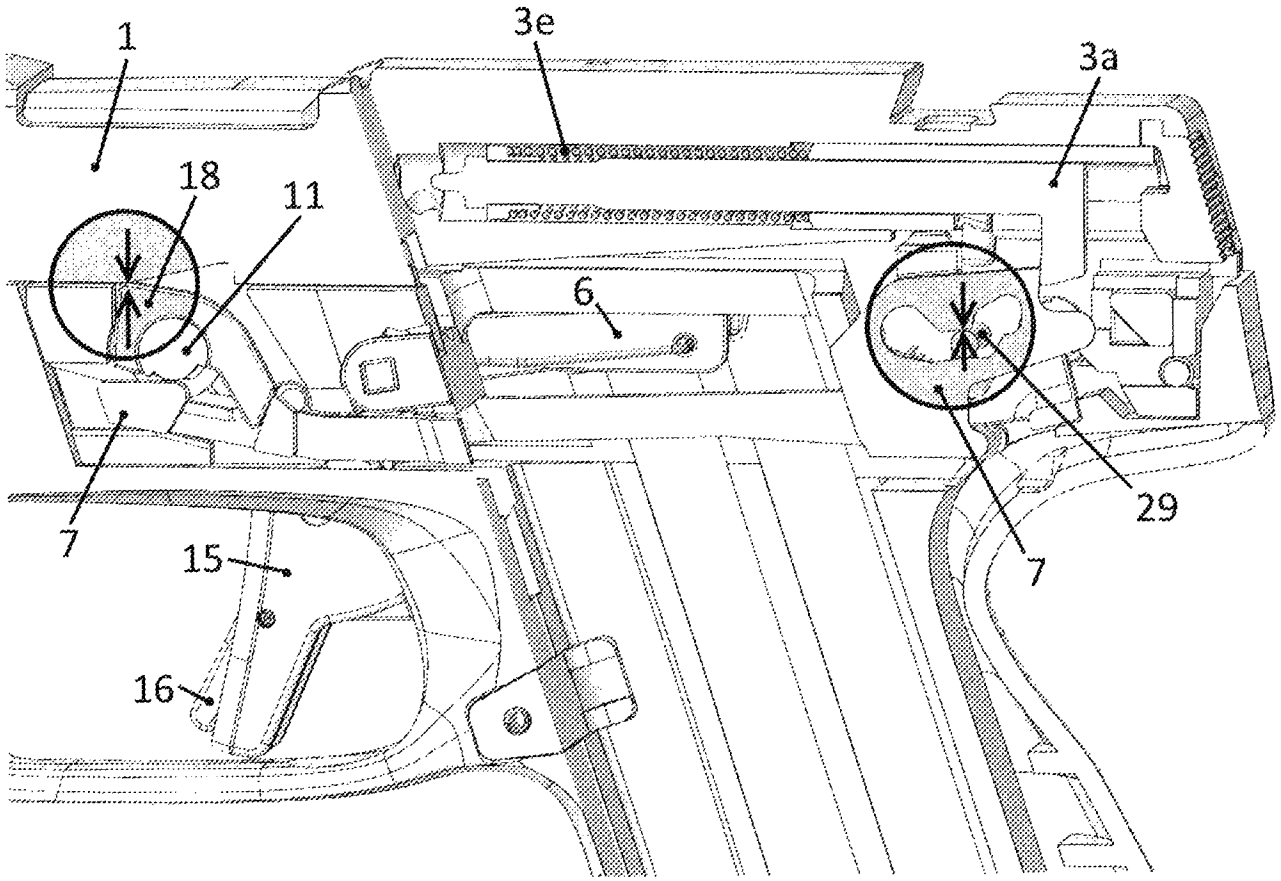
FIG. 10 pistol with the slide at the front end stroke
Figure 11:
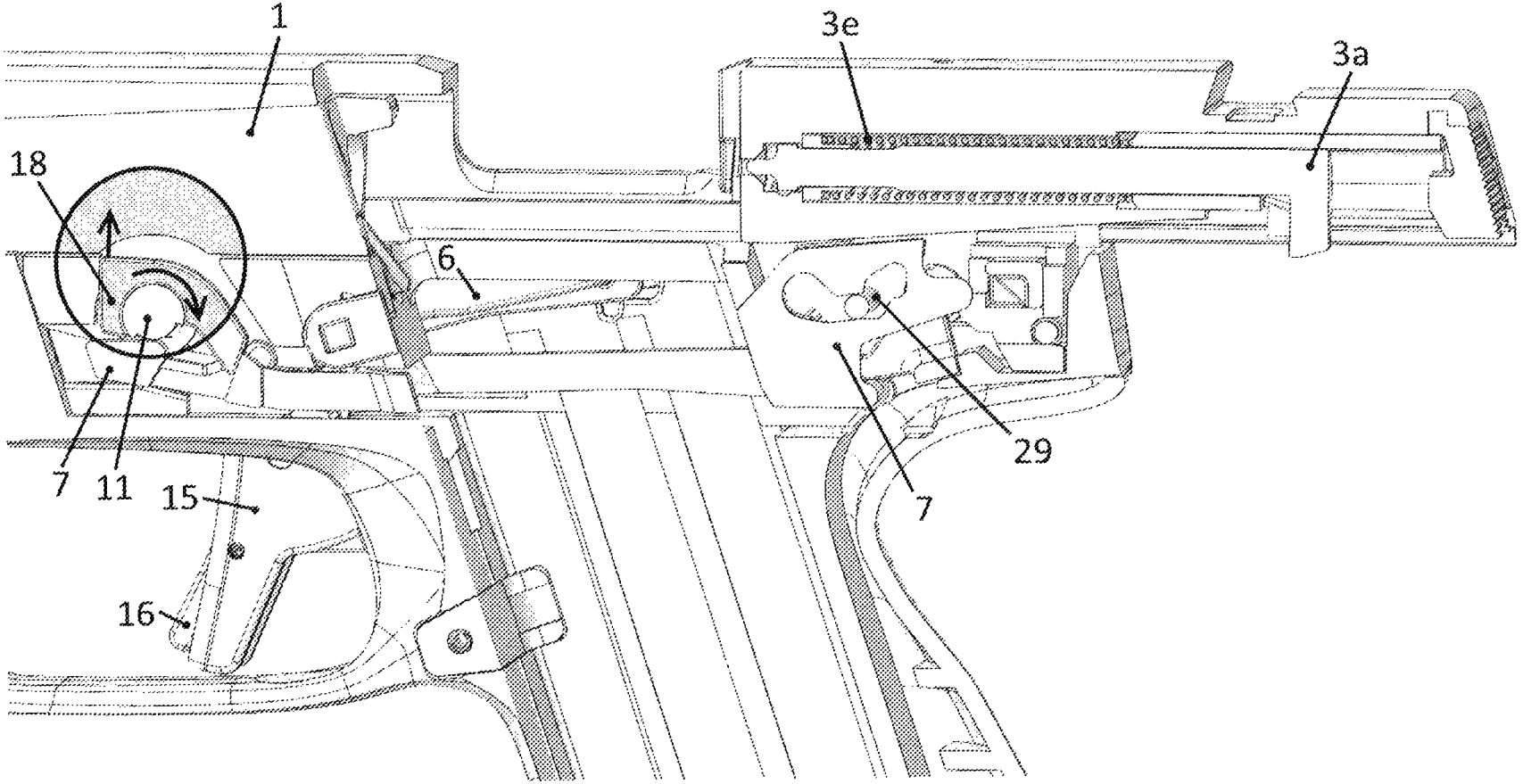
FIG. 11 pistol with the slide in the slide-open position

FIG. 10 shows the pistol with the slide 1 at the front end stroke. The pistol is cannot be disassembled in this position because the disassembling lever 11 is blocked by the slide 1 via its cam 18. This means that the cam 18 collides with the slide 1 and does not enable the disassembling lever 11 to perform the disassembling movement by rotation. This blocking of the movement of the disassembling lever 11 applies to all positions of the slide 1 except the slide-open position of the slide 1, i.e., when the slide 1 is held by the slide stop 6 as shown in FIG. 11. It is desirable to make disassembling of the pistol possible in this position only, because this ensures that the user must open the slide 1 to the slide-open position before the disassembly, discharging any live cartridge from the chamber that may have remained in the chamber due to a user error.

As soon as the slide 1 is in the slide-open position (see FIG. 11) and there is no magazine 39 present in the grip magazine well 13, the disassembling lever 11 can be rotated to start the disassembling. When the disassembling lever 11 is rotated, the cam 18 of the disassembling lever 11 enters the respective recess 1*a* in the slide 1 (see FIG. 16), which is only accessible on the slide 1 in this position of the slide 1. To rotate the disassembling lever 11, the user must make a conscious effort, because the disassembling lever 11 is pre-tensioned towards its locked position by the recoil spring 19.

Figure 12:
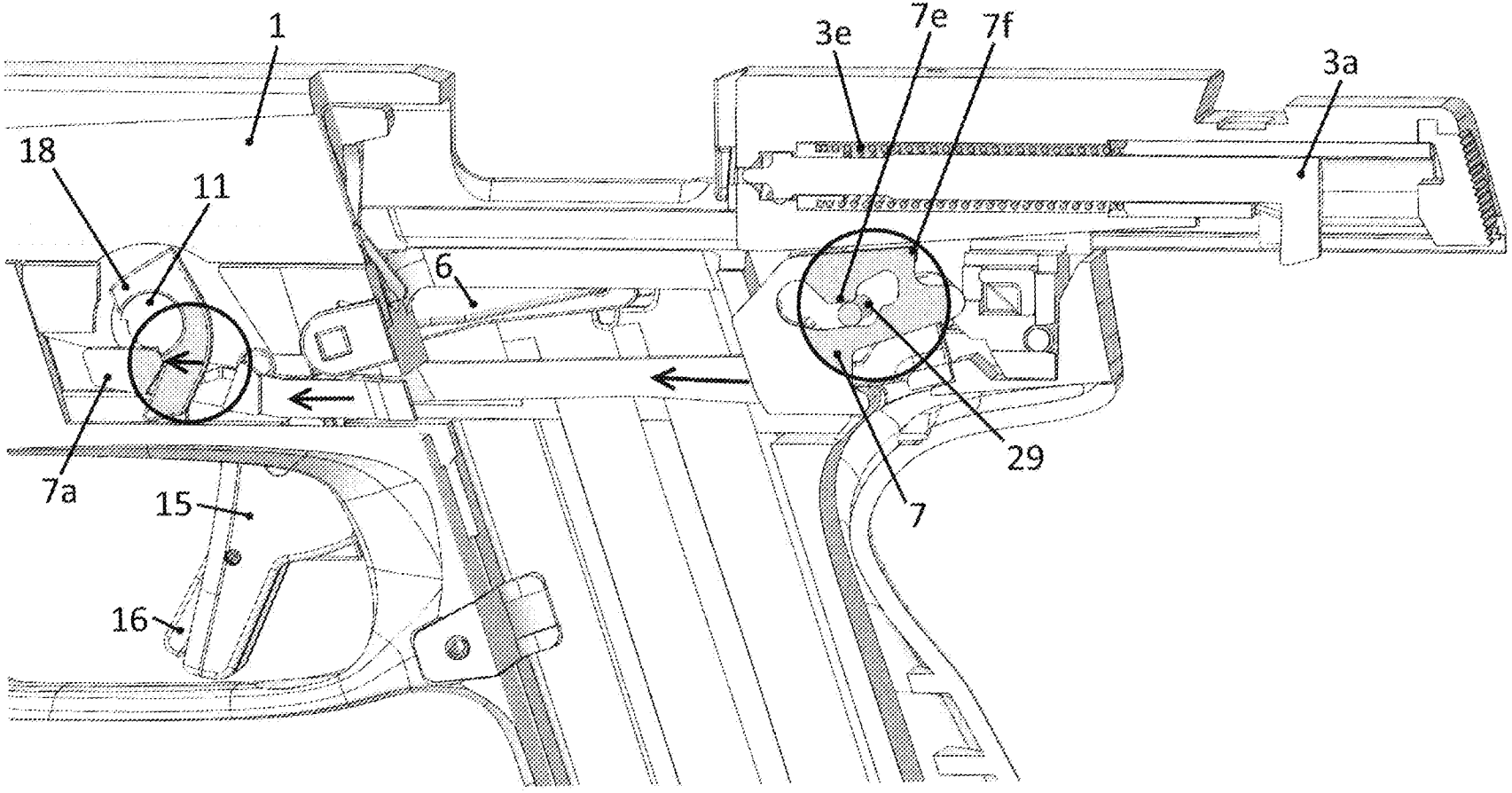
FIG. 12 pistol with the trigger bar at the start of the disassembling position FIG. 13 disengagement of the locking part of the cam of the trigger bar from the control pin FIG. 14 positions during releasing the slide from the pistol frame FIG. 15 detail of the disassembling lever cam entering the recess in the slide FIG. 16 detail of the disassembling lever cam engaging the recess in the slide FIG. 17 detail of the disassembling lever loading with a recoil spring

In the course of rotation of the disassembling lever 11 towards the disassembling position (see FIG. 12), after travelling the given safety angular movement, the cam 18 of the disassembling lever 11 gets in contact with the trigger bar 7. This contact initiates the mechanical action of pistol disassembling, which is realized by the disassembling lever 11 pulling, via the cam 18, on the thumb 7*a* at the front part of the trigger bar 7 (see also the detail in FIG. 16). The pull of the trigger bar 7 causes a shift of its guide cam 7*e* in its rear part towards the cross pin 29. This way, the entire trigger mechanism is automatically brought into the disassembling mode, and lowering of the lug 7*f* of the trigger bar 7 away from the collision path with the firing pin leg 3*a* is started (see also FIG. 13).

Figure 13:
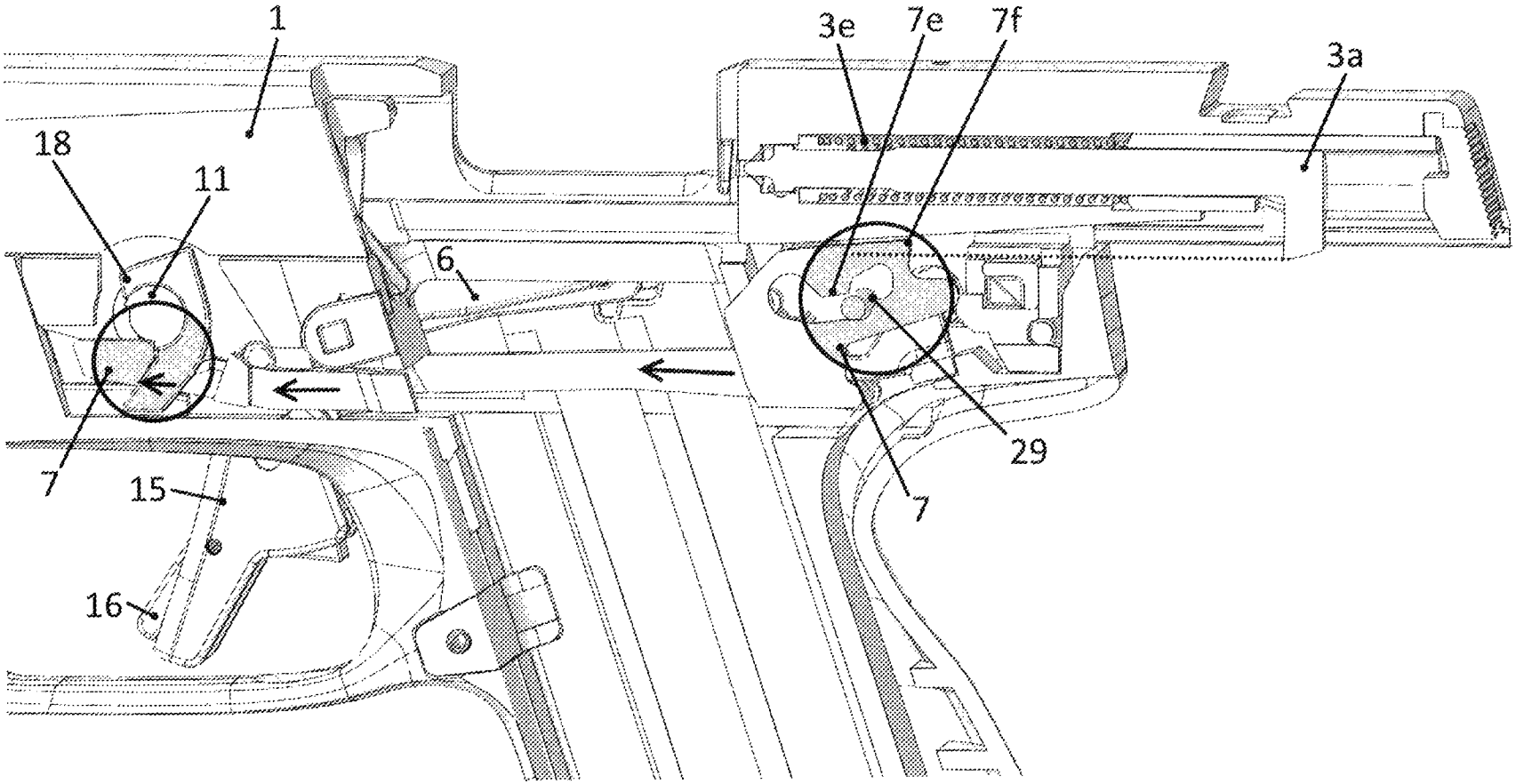

FIG. 13 shows that disengagement of the guide cam 7*e* of the trigger bar 7 from the cross pin 29 has been completed. However, the lug 7*f* of the trigger bar 7 and the firing pin leg 3*a* are still in collision with each other, and therefore the firing pin 3 cannot be released and the slide 1 cannot be removed/disassembled either. This collision is desirable and its purpose is safety. It is not provided for the purpose of disassembly as such, but as a safety mechanism to ensure proper reliable functioning, as it is necessary that the collision between the lug 7*f* of the trigger bar 7 and the firing pin 3*a* leg only be removed at the very end of the disassembling movement. This way, two important facts are ensured:

Firstly, the disassembling of the pistol only occurs at the very end of the disassembling action. Thus, the user must make a conscious effort to disassemble the firearm, which considerably reduces the risk of inadvertent/unintended disassembly of the firearm.

Secondly, the safety collision between the lug 7*f* of the trigger bar 7 and the leg 3*a* of the firing pin is essential for reliability and safety of the weapon during firing, as it ensures that the trigger bar 7 and, consequently, its lug 7*f* are, in the "cocked and ready to shoot" state of the trigger mechanism, firmly blocked against movement and that this blocking is active along a considerable path, and thus insensitive to production tolerances.

Figure 14:
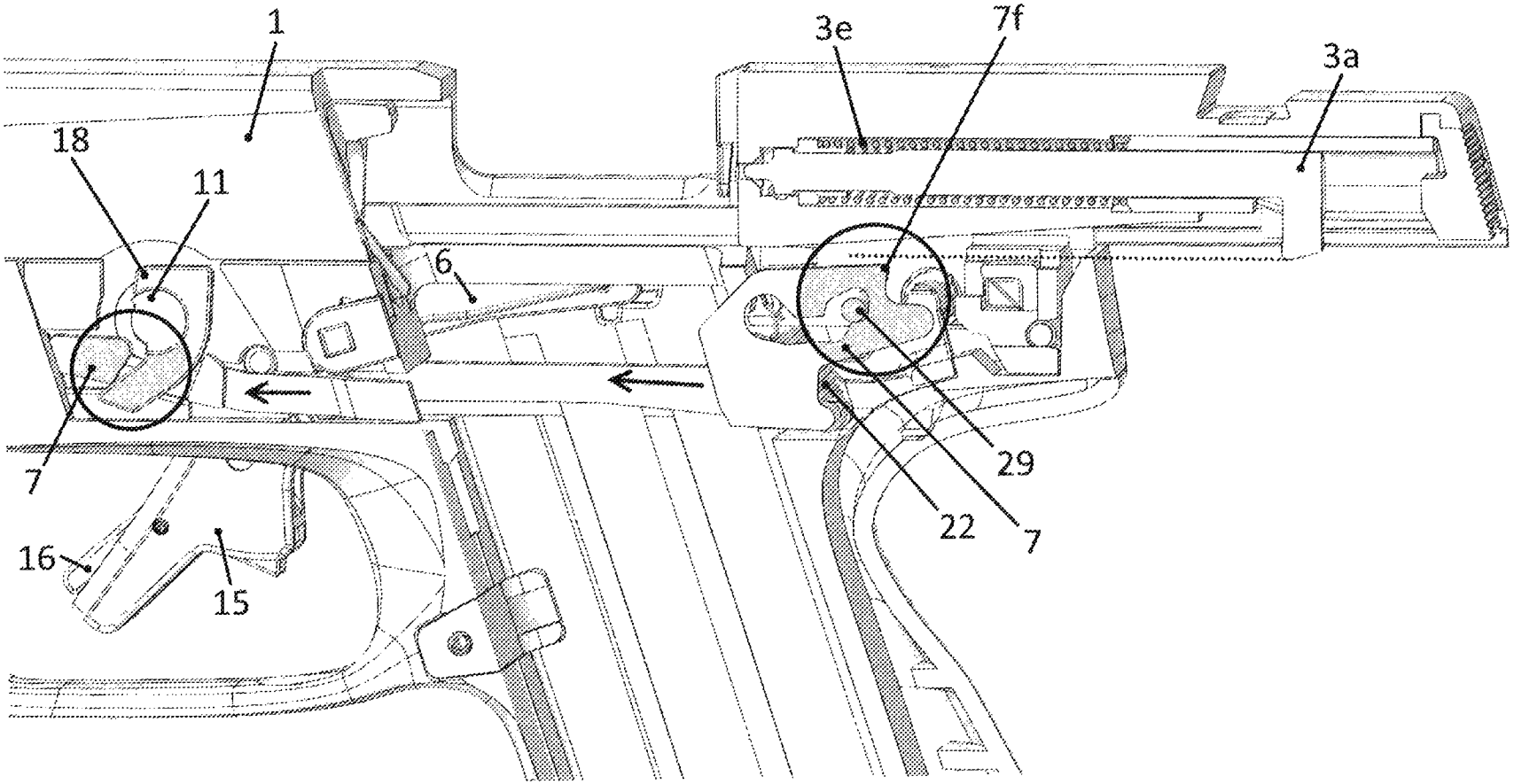

FIG. 14 shows that to completely remove the collision between the lug 7*f* of the trigger bar 7 and the firing pin leg 3*a*, the rotation of the disassembling lever 11 must continue up to its end position, which is approx. 90° angular path from the beginning of its movement. As soon as the disassembling lever 11 is in this end position, the rear part of the trigger bar 7 is lowered below the firing pin leg 3*a* (see the dotted line in FIG. 14). This way, the collision between the lug 7*f* of the trigger bar 7 and the firing pin leg 3*a* is cancelled and the slide 1 can be removed out of the pistol frame after the release of the slide stop 6.

LIST OF REFERENCE SIGNS

1 slide
1*a* recess at the facing side of the slide
3 firing pin
3*a* firing pin leg
6 slide stop
7 trigger bar
7*a* pulling thumb
7*b* vertical guiding groove
7*c* frame part
7*d* block control
7*e* guide cam
7*f* lug
7*g* lowering thumb
7*h* hook
7*i* contact surface
7*j* supporting stop
7*k* arm
7*m* vertical surface
10 trigger bar disconnector
11 disassembling lever
11*a* pivot
11*b* stop for the recoil assembly
11*c* groove for the slide stop spring
11*d* button
11*e* lock
11*f* lock stop
13 grip
15 trigger

16 trigger safety
18 disassembling lever cam
18*a* nose
18*b* protrusion
18*c* stop
19 recoil spring
21 slide stop spring
22 trigger bar springs
28 trigger bar pin
35 trigger pin
39 magazine

The invention claimed is:

1. A self-loading pistol with a pre-cocked firing pin and with an assembly for safe disassembling, comprising a trigger bar (7) with a peripherally at least partly closed frame part (7*c*) to enclose a pistol magazine (39), the frame part (7*c*) having a vertical surface (7*m*) arranged on its rear side in a direction of fire, and on a rear side of the vertical surface, a lug (7*f*) for catching a firing pin (3), wherein the trigger bar (7) is arranged in a pistol frame on a cross pin (29) that passes through the vertical surface (7*m*), and the trigger bar (7) is moveable by means of a trigger (15), and, in the pistol frame over the trigger bar (7), a disassembling lever (11) is arranged, which has a button (11*d*) and a pivot (11*a*) that carries a cam (18) for engagement with the trigger bar (7), characterized in that the cross pin (29) passes through a guide cam (7*e*) arranged in the vertical surface (7*m*), and the vertical surface (7*m*) has, at a side facing the magazine (39), a contact surface (7*i*) for the magazine (39), and an arm (7*k*) protrudes from the frame part (7*c*) at a front side in the direction of fire, and a free end of the arm (7*k*) includes a pulling thumb (7*a*) and a support stop (7*j*) spaced from the pulling thumb (7*a*), wherein the cam (18) has a nose (18*a*) at one side and a protrusion (18*b*) at the opposite side, and the nose (18*a*) reaches between the pulling thumb (7*a*) and the supporting stop (7*j*) of the trigger bar (7) while the protrusion (18*b*) can be inserted into a recess (1*a*) at a facing side of a slide (1).

2. The self-loading pistol according to claim 1, characterized in that the cam (18) is arranged on the pivot (11*a*) of the disassembling lever (11) in a non-rotary and dismountable way.

3. The self-loading pistol according to claim 1, characterized in that the trigger bar (7) is pre-tensioned towards the slide (1).

4. The self-loading pistol according to claim 1, characterized in that two hooks (7*h*) are arranged symmetrically at a bottom edge of the vertical surface (7*m*), and pulling springs (22) of the trigger bar (7) are connected to the hooks (7*h*).

5. The self-loading pistol according to claim 1, characterized in that the guide cam (7*e*) in the vertical surface (7*m*) has a curved shape with raised ends.

* * * * *